US008105253B2

(12) United States Patent
Chen

(10) Patent No.: US 8,105,253 B2
(45) Date of Patent: Jan. 31, 2012

(54) KNEADING MASSAGE DEVICE

(76) Inventor: Hung-Chang Chen, Taichung (TW)

( * ) Notice: Subject to any disclaimer, the term of this patent is extended or adjusted under 35 U.S.C. 154(b) by 860 days.

(21) Appl. No.: 12/168,782

(22) Filed: Jul. 7, 2008

(65) Prior Publication Data

US 2010/0004574 A1 Jan. 7, 2010

(51) Int. Cl.
*A61H 1/00* (2006.01)

(52) U.S. Cl. ..... 601/134; 601/84; 601/90; 601/112

(58) Field of Classification Search ..... 601/98, 601/99, 100, 102, 103, 134, 84, 89, 90, 93, 601/94, 95, 97, 107, 111, 112, 113, 133, 601/136

See application file for complete search history.

(56) References Cited

U.S. PATENT DOCUMENTS 6,394,970 B1 * 5/2002 Maier ..... 601/99
6,808,500 B1 * 10/2004 Cheng-Yi et al. ..... 601/99
6,832,991 B1 * 12/2004 Inada et al. ..... 601/99
7,108,670 B2 * 9/2006 Huang ..... 601/94
2007/0055186 A1 * 3/2007 Hsieh ..... 601/99

* cited by examiner

*Primary Examiner* — Patricia Bianco
*Assistant Examiner* — Raymond E Harris

(57) ABSTRACT

A kneading massage device comprises a driving unit for supplying power source including first and second output shafts for outputting dynamics; a differential unit including a differential set and a differential stem, and on one end of the differential set being formed an opening for inserting the first output shaft therein, and on one side of the differential set being arranged a recess in communication with the opening, the differential stem being located in the recess and in connection with the first output shaft and keeping a predetermined distance away from a sidewall of the recess; a first kneading set coupled to the differential stem so as to be actuated by the differential stem; a second kneading set coupled to the second output shaft so as to be actuated by the second output shaft.

7 Claims, 9 Drawing Sheets

KNEADING MASSAGE DEVICE

BACKGROUND OF THE INVENTION

1. Field of the Invention

The present invention relates to a massage device, and more particularly to a kneading massage device that is produced in less time and at lower cost.

2. Description of the Prior Art

Conventional massage machines are used to massage different positions, such as back, neck, and legs; however, they can not obtain a kneading massage in a non-simultaneous rotating manner. Besides, they are always produced at high cost and in long time.

The present invention has arisen to mitigate and/or obviate the afore-described disadvantages.

SUMMARY OF THE INVENTION

The primary objective of the present invention is to provide a kneading massage device that is produced in less time and at lower cost.

To achieve the above objective, the kneading massage device provided in accordance with the present invention comprises a driving unit for supplying power source including first and second output shafts for outputting dynamics; a differential unit including a differential set and a differential stem, and on one end of the differential set being formed an opening for inserting the first output shaft therein, and on one side of the differential set being arranged a recess in communication with the opening, the differential stem being located in the recess and in connection with the first output shaft and keeping a predetermined distance away from a sidewall of the recess; a first kneading set coupled to the differential stem so as to be actuated by the differential stem; a second kneading set coupled to the second output shaft so as to be actuated by the second output shaft, such that as the differential stem rotates but not contact with the sidewall of the recess, the first kneading set is not actuated to rotate, hence the first and second kneading sets rotate non-simultaneously to have a kneading massage.

DETAILED DESCRIPTION OF THE PREFERRED EMBODIMENTS

Figure 1:
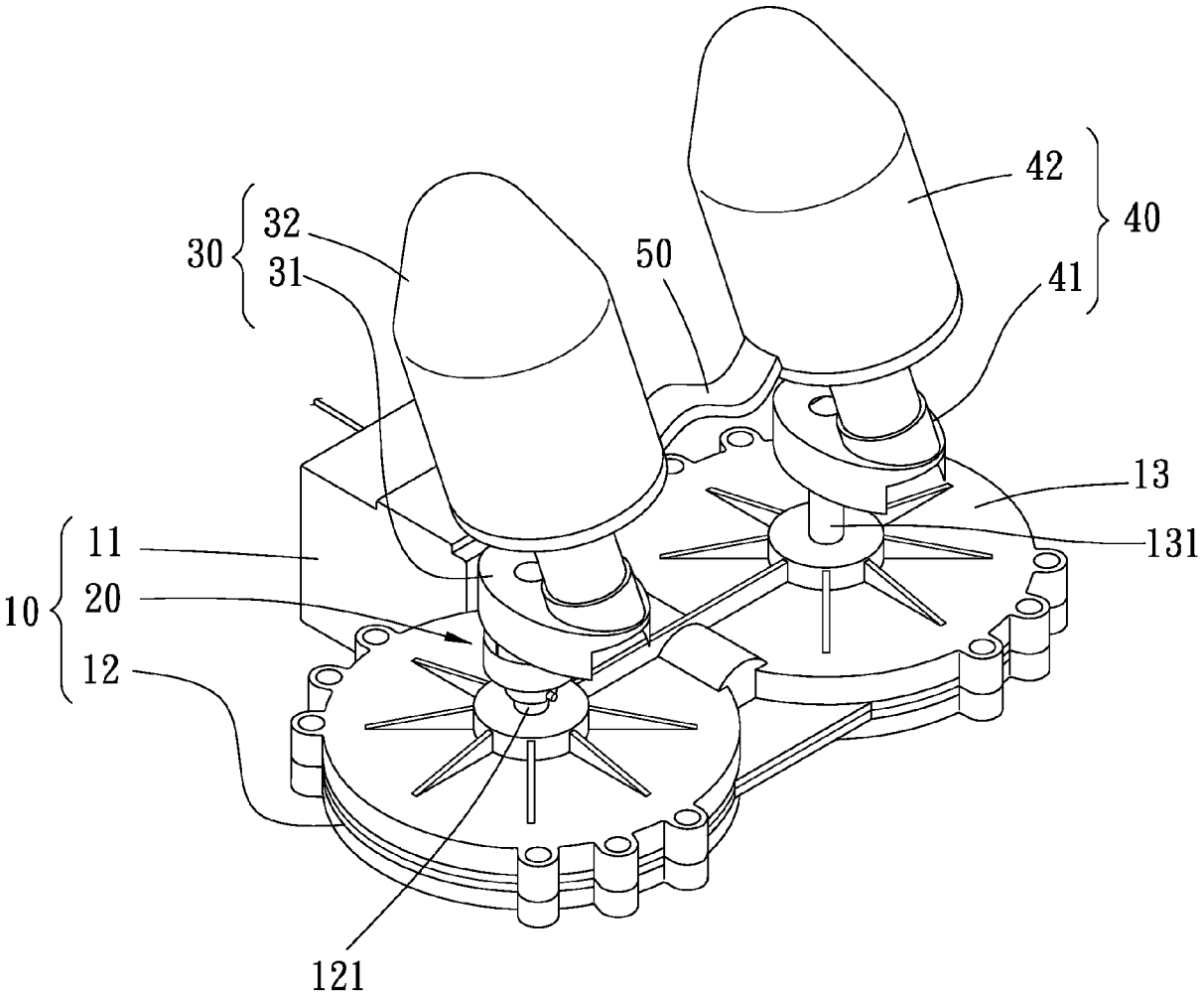
FIG. 1 is a perspective view illustrating the assembly of a kneading massage device according to a preferred embodiment of the present invention.

The present invention will be clearer from the following description when viewed together with the accompanying drawings, which show, for purpose of illustrations only, the preferred embodiment in accordance with the present invention.

Referring to FIGS. 1-12, a kneading massage device 100 in accordance with a preferred embodiment of the present invention comprises a driving unit 10, a differential unit 20, a first kneading set 30, a second kneading set 40, and an elongated strap 50.

Figure 2:
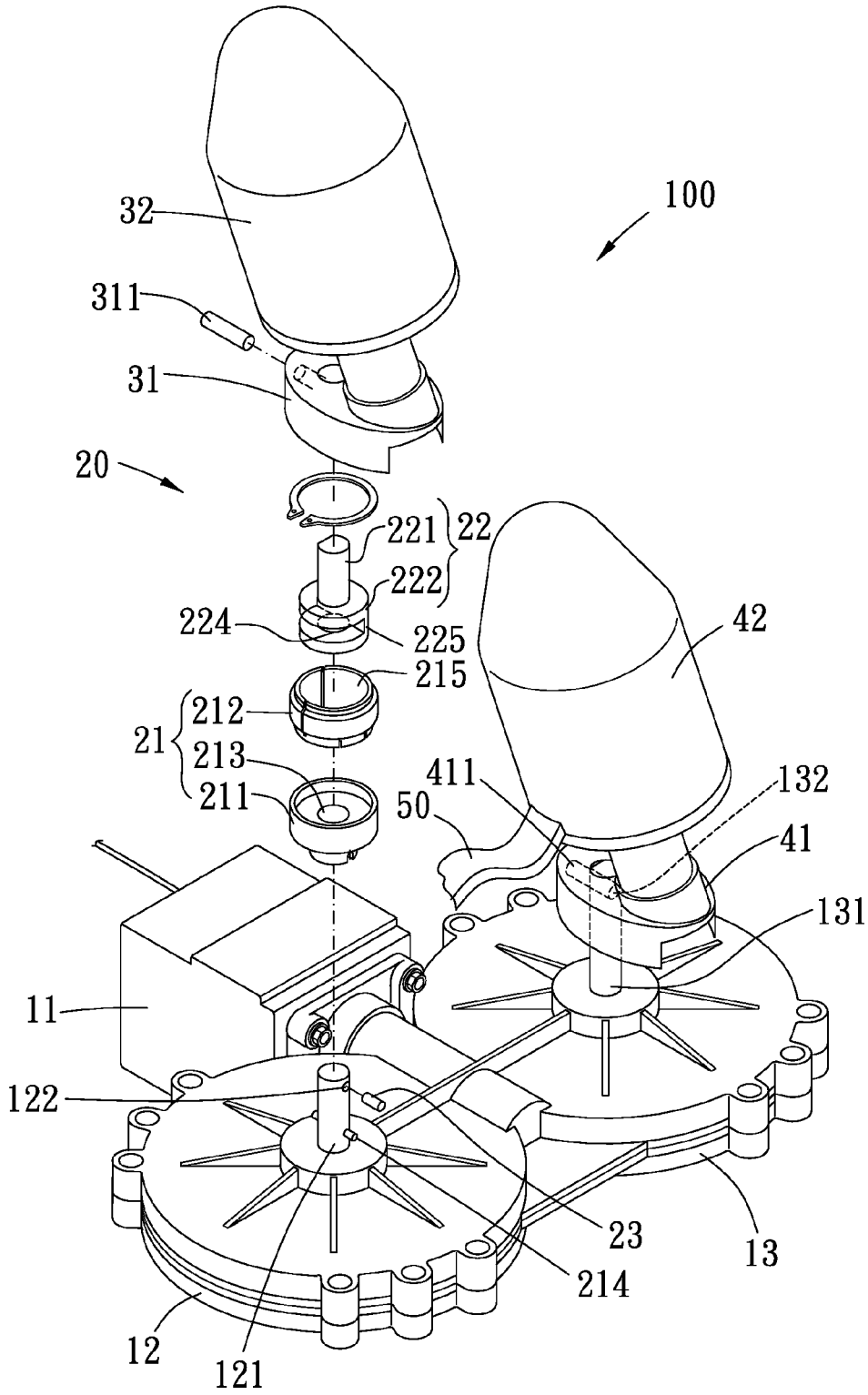
FIG. 2 is a perspective view illustrating the exploded components of the kneading massage device according to the preferred embodiment of the present invention.

The driving unit 10, as illustrated in FIGS. 1 and 2, includes a transmission motor 11 and first and second speed variable gear sets 12, 13. The transmission motor 11 is provided to supply power source, and the first and second speed variable gear sets 12, 13 are connected with the rotatable shaft (not shown) of the transmission motor 11 so as to adjust the rotating speed of the rotatable shaft of the transmission motor 11 to a predetermined speed, and then the dynamics are outputted through the first and second output shafts 121, 131 of the first and second speed variable gear sets 12, 13 individually. Besides, on the outer rims adjacent to the tops of the first and second output shafts 121, 131 are formed radial first and second lateral holes 122, 132 respectively.

Figure 2A:
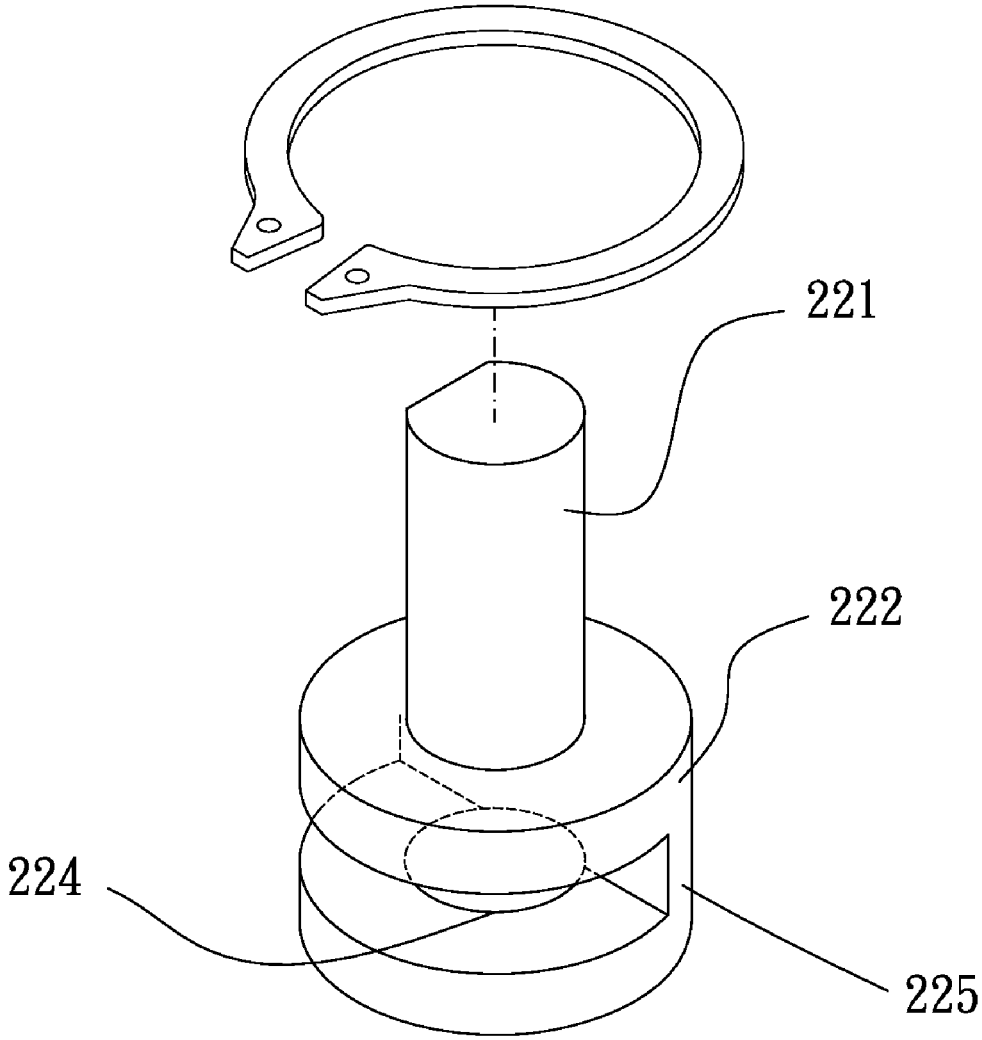
FIG. 2A is a partial enlargement drawing of FIG. 2.
Figure 3:
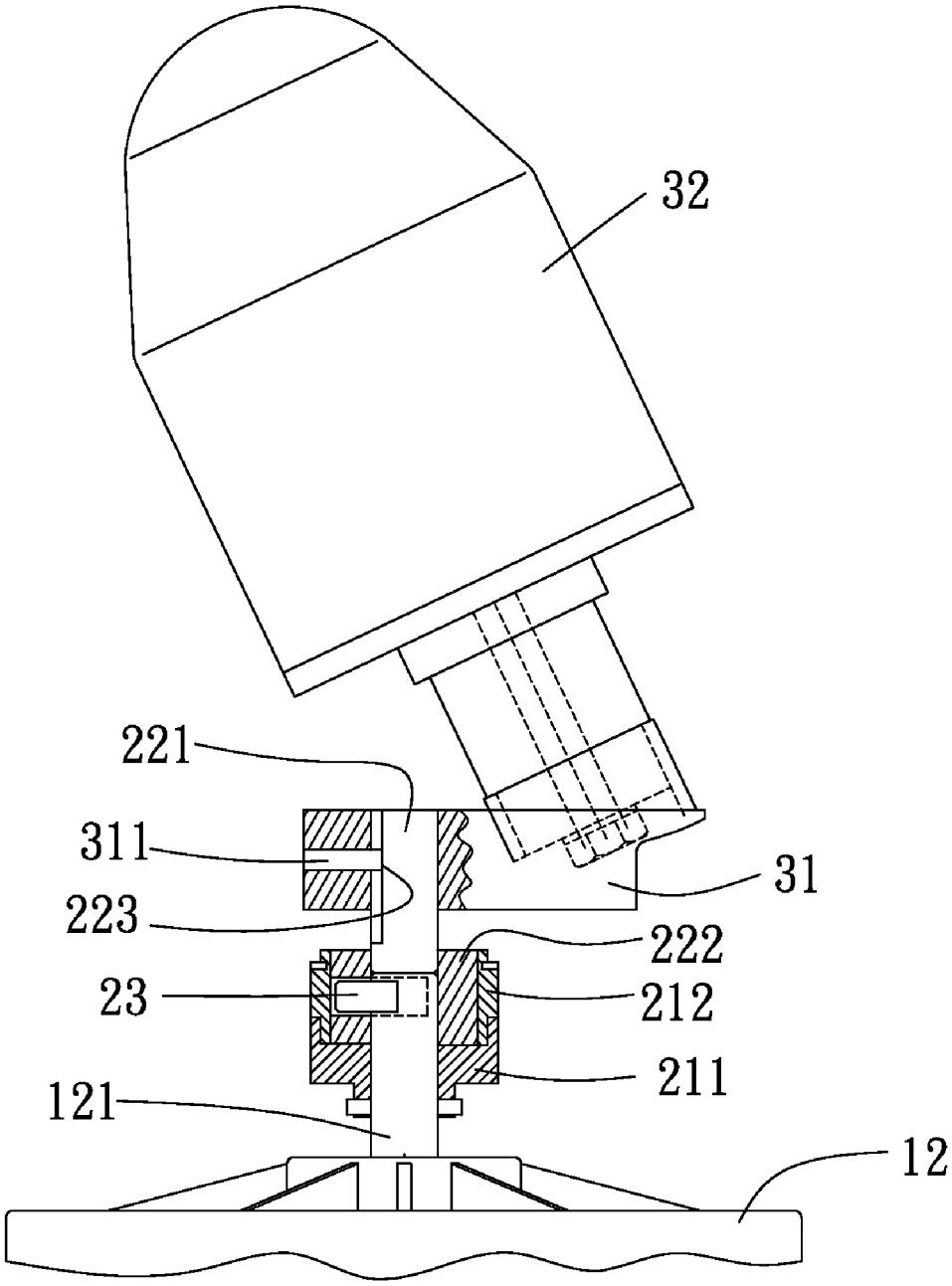
FIG. 3 is a cross sectional view illustrating the assembly of the kneading massage device according to the preferred embodiment of the present invention.
Figure 4:
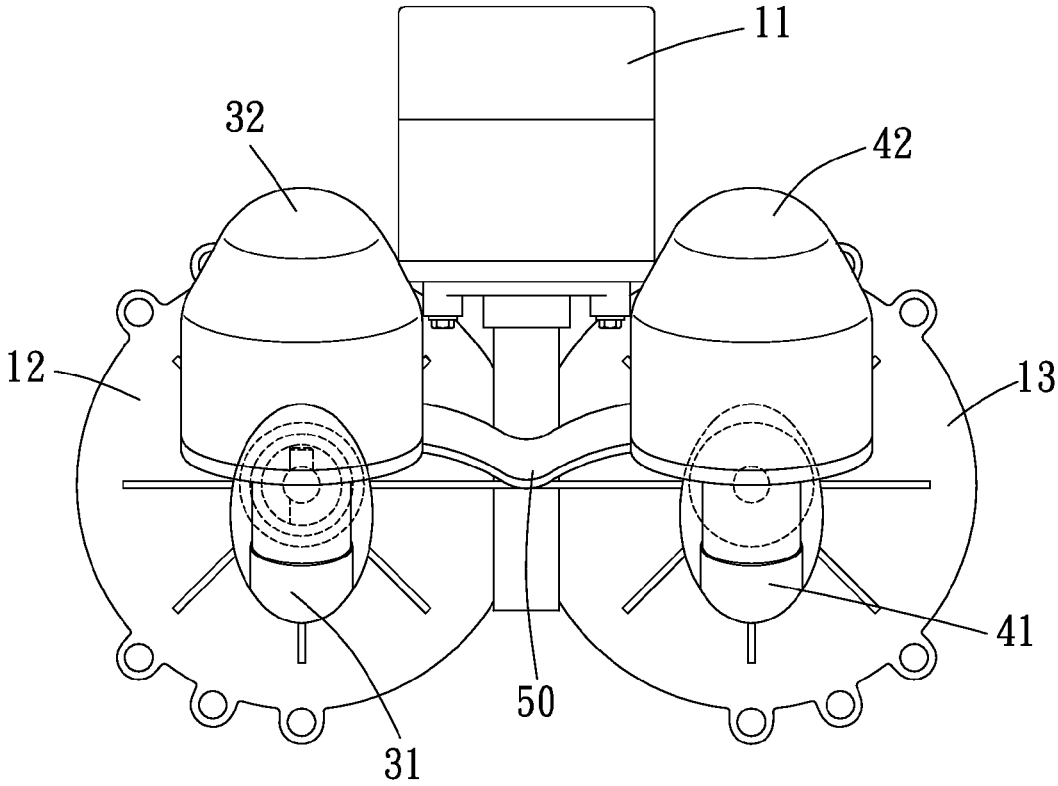
FIG. 4 is a top plan view illustrating the operational state of the kneading massage device according to the preferred embodiment of the present invention.
Figure 5:
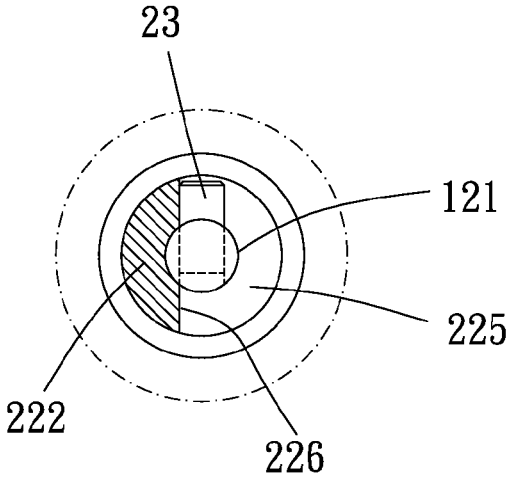
FIG. 5 is a partial cross section view illustrating the operational state of the kneading massage device according to the preferred embodiment of the present invention.
Figure 6:
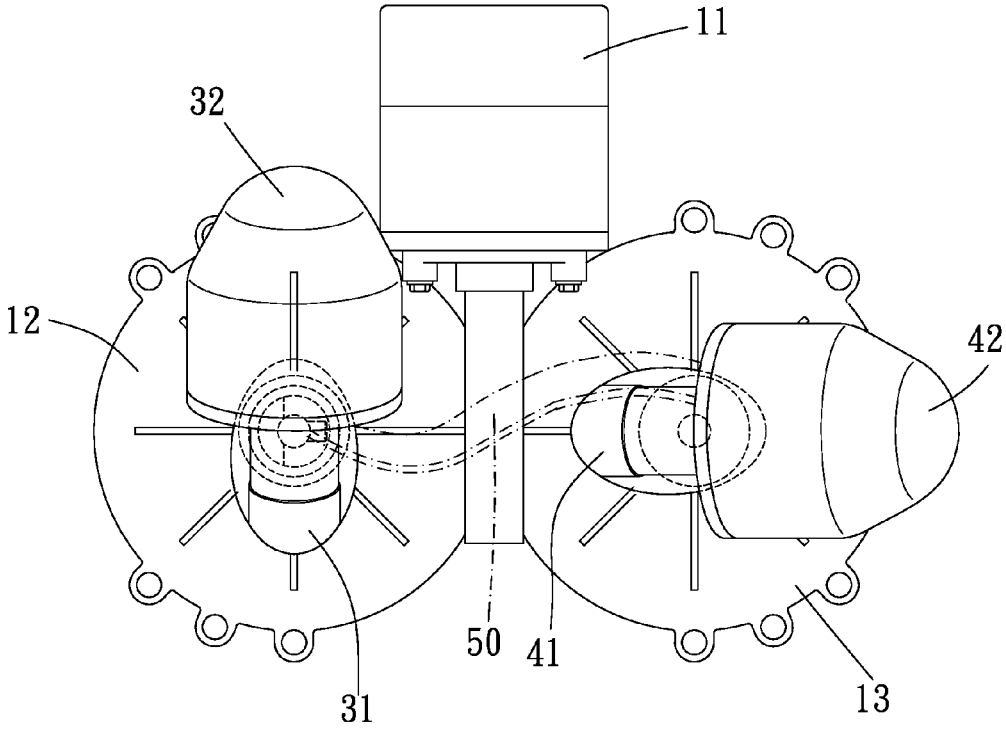
FIG. 6 is a partial top plan view illustrating the operational state of the kneading massage device according to the preferred embodiment of the present invention.
Figure 7:
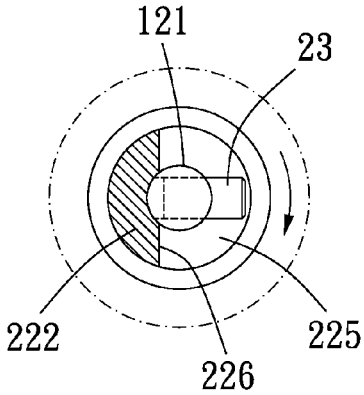
FIG. 7 is another partial cross section view illustrating the operational state of the kneading massage device according to the preferred embodiment of the present invention.

Referring to FIGS. 2 and 3, the differential unit 20 includes a protective assembly 21, a differential set 22 and a differential stem 23. The protective assembly 21 includes a holding seat 211 which has an axial bore 213 arranged in axial direction thereof so as to be fitted to the first output shaft 121 of the driving unit 10, and includes a housing member 212. The holding seat 211 is securely coupled with the first output shaft 121 by using two bolt members 214 so as to rotate with the first output shaft 121, and then the housing member 212 is fitted onto the holding seat 211 and includes a through aperture 215 formed in axial direction thereof so as to fit the first output shaft 121 therein. The differential set 22 includes a coupling segment 221 and a differential segment 222, the coupling segment 221 is an axial shank with a non-circle cross section, as shown in FIG. 2, FIG. 2A, and FIG. 3, and on one side of the coupling segment 221 is mounted an insertion orifice 223. The differential segment 222 is formed in the shape of a cylinder, and its one end is connected with one end of the coupling segment 221 in the same axis, on the free end of the differential segment 222 is fixed an opening 224 extending in axial direction, and on one side of the differential segment 222 is formed a recess 225 with a predetermined width (in this embodiment of the present invention, the degree of the width of the recess is 180 degrees), and the recess 225 is in communication with the opening 224. The differential segment 222 is inserted in the through aperture 215 of the housing member 212, and the top end of the first output shaft 121 is inserted into the opening 224, hence the first lateral hole 122 is located in the recess 215. The differential stem 23 is a bolt which is inserted from the recess 225 of the different shaft 22 into the first lateral hole 122 of the first output shaft 121 so that its partial portion is located in the recess 225.

As shown in FIGS. 1-3, the first kneading set 30 includes a first connecting mount 31 and a first kneading body 32. The first connecting mount 31 is inserted in the insertion orifice 223 of the coupling segment 221 of the differential unit 20 by way of a pillar 311 so that the first connecting mount 31 is coupled with the differential set 22 so as to be urged to rotate, and one end of the first kneading body 32 is axially coupled to the first connecting mount 31, the first kneading body 32 is made of resilient material.

As shown in FIGS. 1-3, the second kneading set 40 includes a second connecting mount 41 and a second kneading body 42. The second connecting mount 41 is inserted in the second lateral hole 132 of the second output shaft 131 by way of a bolt 411, such that the second connecting mount 41 is coupled with the second output shaft 131 so as to be urged to rotate, and one end of the second kneading body 42 is axially coupled to the second connecting mount 41, the second kneading body 42 is made of resilient material.

With reference to FIG. 1, the two ends of the elongated strap 50 are coupled onto the first and second kneading bodies 32, 42 respectively, and the elongated strap 50 is positioned between the first and second kneading bodies 32, 42.

Figure 12:
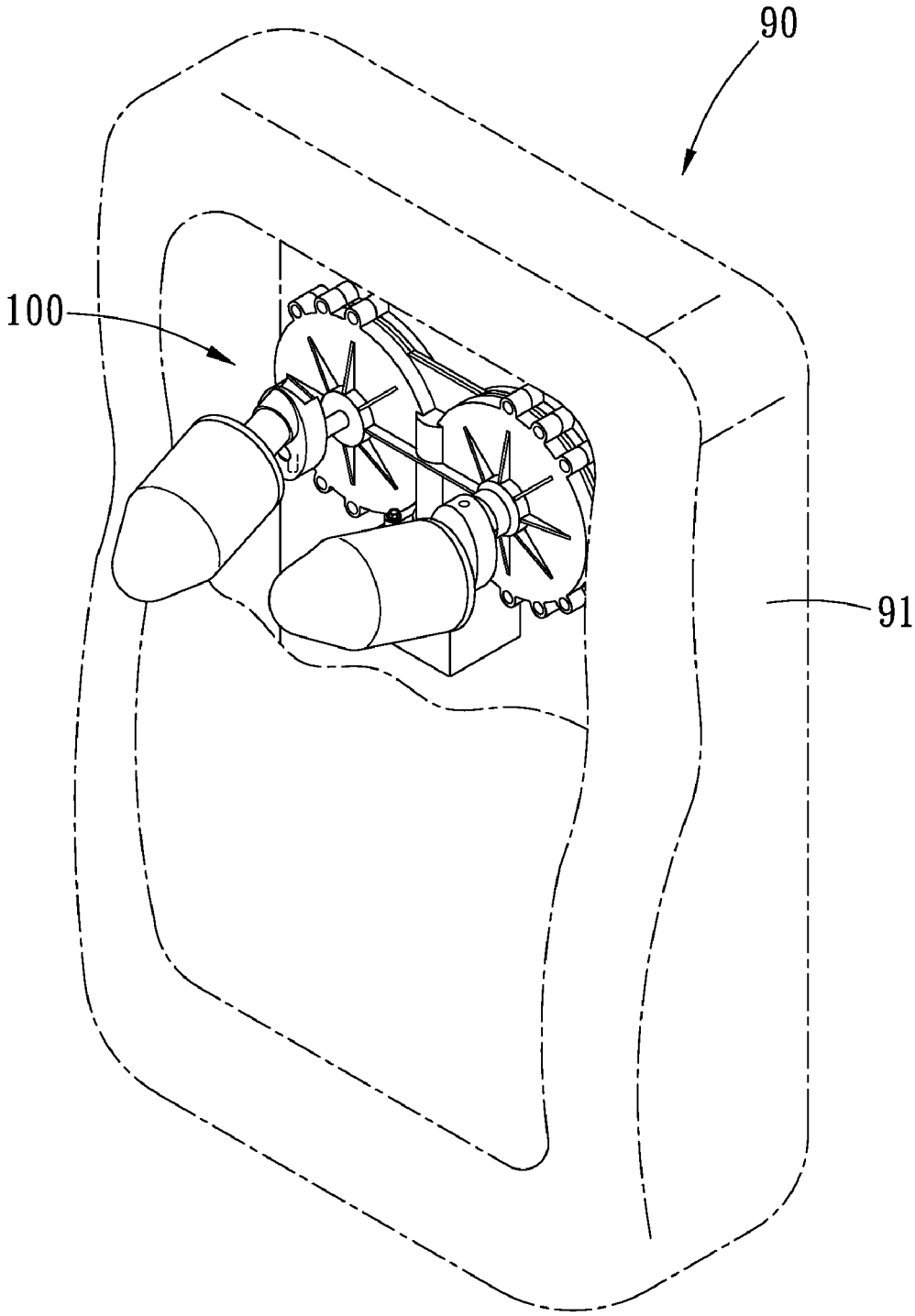
FIG. 12 is a perspective view illustrating the kneading massage device of the present invention being installed onto a chair back of a massage chair.

It can be clearly seen from the preceding accounts on the features of the present invention that the kneading massage device 100 of the present invention has the following advantages:

The kneading massage device 100 is allowed to be installed onto a chair back 91 of a massage chair 90 as illustrated in FIG. 12 and fixed in any desired position while in use.

As the driving unit 10 is started by the power source, it drives the first and second output shafts 121, 131 of the first and second speed variable gear sets 12, 13 to operate, and then the second kneading set 40 is actuated to rotate by the second output shaft 131. Since the first kneading set 30 is connected onto the differential set 22 of the differential unit 20, the first kneading set 30 is driven to rotate by the differential set 22 which is urged by the first output shaft 121. Thus, the first output shaft 121 is not started simultaneously. the differential stem 23 of the first output shaft 121 only rotates in the recess 225 of the differential set 22 but can not actuate the first kneading set 30 to rotate immediately (as shown in FIGS. 4-7).

Figure 8:
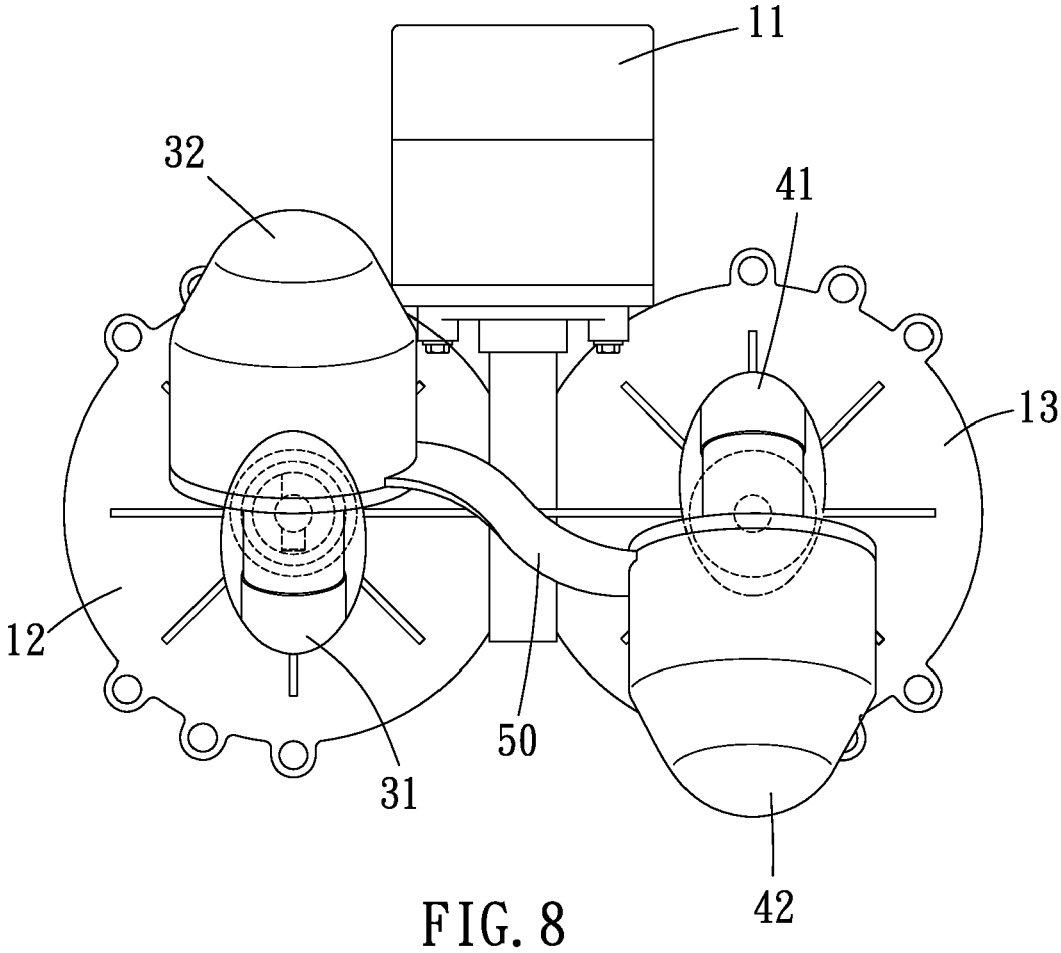
FIG. 8 is another top plan view illustrating the operational state of the kneading massage device according to the preferred embodiment of the present invention.
Figure 9:
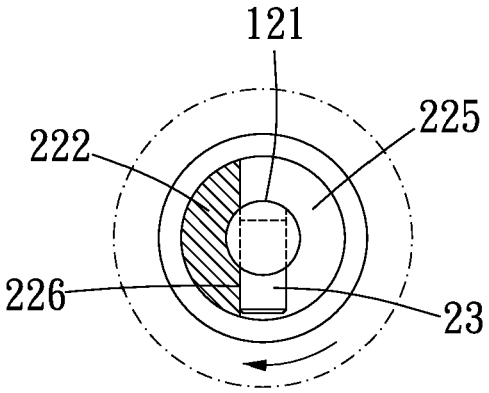
FIG. 9 is also another partial cross section view illustrating the operational state of the kneading massage device according to the preferred embodiment of the present invention.
Figure 10:
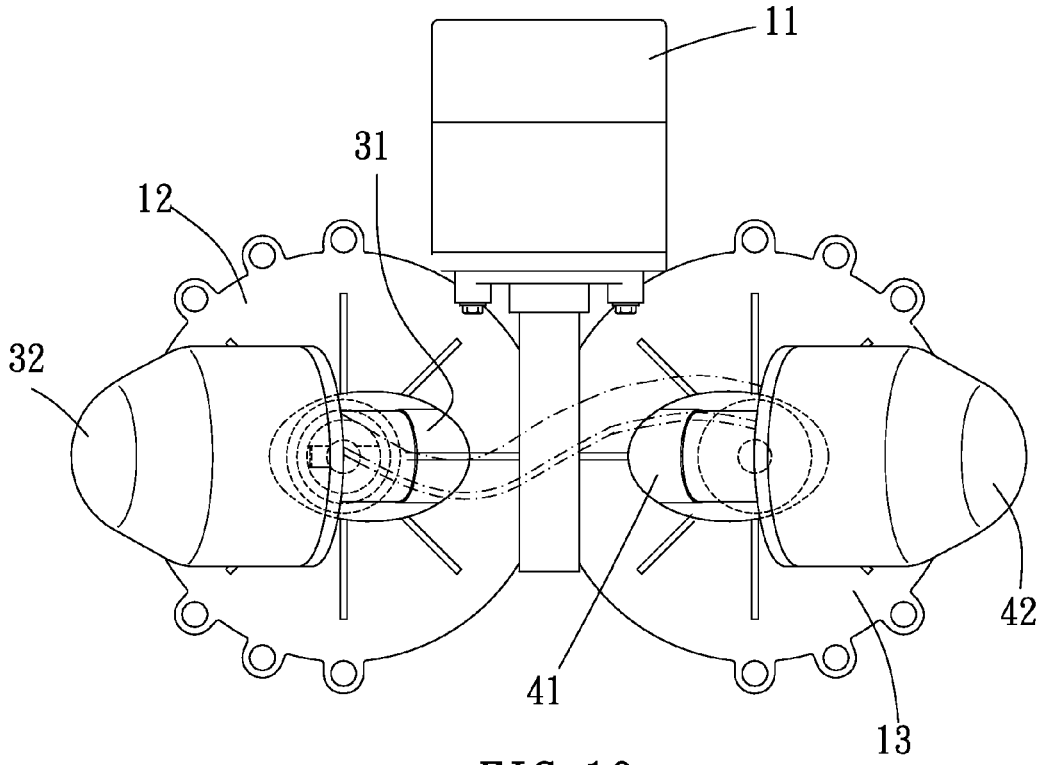
FIG. 10 is also another partial top plan view illustrating the operational state of the kneading massage device according to the preferred embodiment of the present invention.
Figure 11:
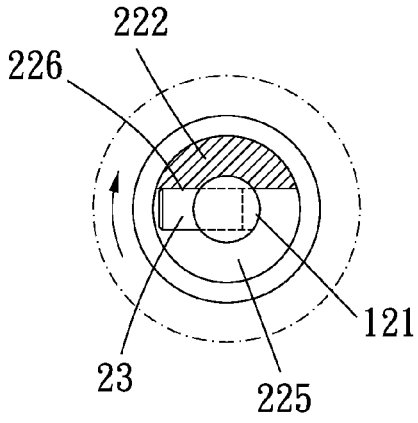
FIG. 11 is another partial cross section view illustrating the operational state of the kneading massage device according to the preferred embodiment of the present invention.

After the first output shaft 121 of the differential unit 20 has rotated 180 degrees, the differential stem 23 contacts with the side wall 226 of the recess 225 so as to drive the rotation of the differential set 22 and the first kneading set 30, and at the time the second kneading set 40 has rotated 180 degrees already (as shown in FIGS. 8 and 9). After the first kneading set 30 is actuated to rotate, it keeps on rotating but space apart 180 degrees from the second kneading set 40 (as illustrated in FIGS. 10 and 11), such that the kneading massage may be obtained, wherein the elongated strap 50 is used to support the user's hands or feet, and the sides of the first and second kneading bodies 32, 42 are provided to have a kneading massage.

While we have shown and described various embodiments in accordance with the present invention, it is clear to those skilled in the art that further embodiments may be made without departing from the scope of the present invention.

What is claimed is:

1. A kneading massage device comprising:

a driving unit for supplying power source including first and second output shafts for outputting dynamics;

a differential unit including a differential set and a differential stem, and on one end of said differential set being formed an opening for inserting said first output shaft therein, and on one side of said differential set being arranged a recess in communication with said opening, said differential stem being located in said recess and in connection with said first output shaft and keeping a predetermined distance away from a sidewall of said recess;

a first kneading set coupled to said differential stem so as to be actuated by said differential stem;

a second kneading set coupled to said second output shaft so as to be actuated by said second output shaft;

wherein said differential unit further includes a protective assembly having a holding seat which has an axial bore arranged in axial direction thereof so as to be fitted to said first output shaft of said driving unit and having a housing member, and said holding seat is securely coupled with said first output shaft by using two bolt members so as to rotate with said first output shaft, and then said housing member is fitted onto said holding seat and includes a through aperture formed in axial direction thereof so as to fit said first output shaft therein.

2. The kneading massage device as claimed in claim 1, wherein said differential set includes a coupling segment and a differential segment, and on one side of said coupling segment is mounted an insertion orifice, and one end of said differential segment is connected with one end of said coupling segment in the same axis, on the free end of said differential segment is fixed said opening extending in axial direction, and on one side of said differential segment is formed said recess with a predetermined width.

3. The kneading massage device as claimed in claim 2, wherein said coupling segment is an axial shank with a non-circle cross section.

4. The kneading massage device as claimed in claim 1, wherein on the outer rims adjacent to the tops of said first and second output shafts are formed radial first and second lateral holes respectively, and said first lateral hole of said first output shaft is provided to insert said differential stem therein, and said second lateral hole of said second output shaft is provided to insert a bolt therein so as to connect said second output shaft with said second kneading set.

5. The kneading massage device as claimed in claim 1, wherein said first kneading set includes a first connecting mount and a first kneading body, said first connecting mount is coupled with said differential set so as to be urged to rotate, and one end of said first kneading body is axially coupled to said first connecting mount, said second kneading set includes a second connecting mount and a second kneading body, said second connecting mount is coupled with said second output shaft so as to be urged to rotate, and one end of said second kneading body is axially coupled to said second connecting mount.

6. The kneading massage device as claimed in claim 1, wherein said first and second kneading bodies are made of resilient materials.

7. The kneading massage device as claimed in claim 1 further comprising an elongated strap, two ends of which are coupled onto said first and second kneading bodies respectively, being positioned between said first and second kneading bodies.

* * * * *